US006148726A

United States Patent [19]

Harada

[11] Patent Number: 6,148,726

[45] **Date of Patent: *Nov. 21, 2000**

[54] TUBULAR BLANKET AND PRINTING MACHINE USING TUBULAR BLANKET

[75] Inventor: Takao Harada, Hiroshima-ken, Japan

[73] Assignee: Mitsubishi Heavy Industries, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/076,001

[22] Filed: May 12, 1998

[30] Foreign Application Priority Data

May 13, 1997 [JP] Japan ..... 9-122634

[51] Int. Cl.[7] ..... B41N 10/02

[52] U.S. Cl. ..... 101/217; 101/375

[58] Field of Search ..... 101/217, 375, 101/376, 401.1, 492, 493; 492/18, 48; 428/909

[56] References Cited

U.S. PATENT DOCUMENTS

| | | | |
|---|---|---|---|
| 1,428,795 | 9/1922 | Mezger | 101/217 |
| 1,576,726 | 3/1926 | Davis | 492/25 |
| 1,804,139 | 5/1931 | Adsit et al. | 101/217 |
| 2,447,991 | 8/1948 | Stempel | 101/217 |
| 3,750,250 | 8/1973 | Brown | 101/401.1 |
| 5,215,013 | 6/1993 | Vrotacoe et al. | 101/217 |
| 5,507,226 | 4/1996 | Burke et al. | 101/375 |
| 5,515,781 | 5/1996 | Songer | 101/375 |
| 5,577,443 | 11/1996 | Songer | 101/375 |
| 6,062,138 | 5/2000 | Fromson et al. | 101/376 |

FOREIGN PATENT DOCUMENTS

| | | | |
|---|---|---|---|
| 76777 | 4/1983 | European Pat. Off. | 101/376 |
| 0444195A1 | 9/1991 | European Pat. Off. . | |
| 25 14 294 | 10/1976 | Germany . | |
| 92 03 874 | 4/1993 | Germany . | |
| 1091068 | 11/1967 | United Kingdom . | |
| 86/05447 | 9/1986 | WIPO | 101/375 |

*Primary Examiner*—Stephen R. Funk
*Attorney, Agent, or Firm*—Armstrong, Westerman, Hattori, McLeland & Naughton

[57] ABSTRACT

The present invention relates to a tubular blanket which comprises a main blanket section having at least a portion coming into contact with a printing-made web and a remaining blanket section other than the main blanket section. The remaining blanket section has a thickness thinner than the thickness of the main blanket section. Thus, even if inks or paper particles are attached to a web absent area on a circumferential surface of the tubular blanket, it is possible to eliminate the influence from the attachment of inks or paper particles, and to make the web cut-off hard to occur, so that the interference with the use of the tubular blanket is preventable, thereby enhancing the economy and the working efficiency.

20 Claims, 9 Drawing Sheets

TUBULAR BLANKET AND PRINTING MACHINE USING TUBULAR BLANKET

BACKGROUND OF THE INVENTION (1) Field of the Invention

The present invention relates to a tubular blanket to be used for a blanket barrel (cylinder) of a printing machine, and to a printing machine using the tubular blanket.

(2) Description of the Related Art

A printing unit of an offset printing machine has basically been composed of a blanket and a printing cylinder, and recently, tubular blankets have come into widespread use.

For explanation of a tubular blanket, a printing unit of a blanket-to-blanket printing machine for conducting offset printing onto both surfaces of a web is taken as one example, but the description will be limited to its blanket section. FIG. 9 is a perspective view illustratively showing a construction of a principal section of a blanket-to-blanket printing machine using a tubular blanket, and FIG. 10 is a cross-sectional view corresponding to FIG. 9.

As shown in FIGS. 9 and 10, a pair of blanket barrels 1 are disposed in parallel to each other to be in an opposed relation to each other in a state where a web 2 is interposed therebetween. Further, a plurality of compressed air discharging openings (not shown) are made in circumferential surfaces in the vicinity of end portions of the blanket barrels 1, and tubular blankets 3 are respectively fitted over the overall circumferences of the blanket barrels 1 to cover the compressed air discharging openings. Each of the tubular blankets 3 serves as an elastic layer constructed by piling up a blanket layer made of a rubber, a fiber, a resin, an adhesive or the like on a sleeve made of an elastic material such as a metal having a high stiffness. The tubular blanket 3 always needs to cover the aforesaid compressed air discharging openings in use, and therefore, to say the least of it, the length of the sleeve of the tubular blanket 3 in its axial directions is required to be substantially equal to the length of the circumferential surface of the blanket barrel 1 in its axial direction.

In addition, the blanket barrels 1 are located so that the web 2 is placed between the tubular blankets 3 to be pressed, and further, the blanket barrels 1 are made to be synchronously rotatable in directions of arrows a, b by a non-shown drive unit, respectively.

Furthermore, at portions on upper and lower sides of the web 2, non-shown printing cylinders are disposed to be synchronously rotatable while coming into contact with the tubular blankets 3 on both sides, respectively, and inks and water for a picture design to be put into print are applied onto the circumferential surfaces of the printing cylinders.

With this constitution, when the web 2 is inserted into the gap between the upper and lower tubular blankets 3 to pass through therebetween in a direction of an arrow c, in a manner that the non-shown printing cylinders, made to be brought into contact with the upper and lower tubular blankets 3, rotates synchronously while coming into contact with the tubular blankets 3, the inks put on the circumferential surfaces of the printing cylinders are transferred onto the circumferential surfaces of the upper and lower tubular blankets 3, respectively.

When the pair of tubular blankets 3, disposed to be in an opposed relation to positions on the upper and lower sides of the web 2, rotates in accordance with the movement of the web 2 while pressing it, the inks transferred onto the tubular blankets 3 are further transferred onto the web 2 to accomplish the offset printing on the web 2.

Incidentally, in detaching the tubular blankets 3 fitted over the blanket barrels 1 or attaching it thereon, the inner diameters of the tubular blankets 3 are enlarged in a manner of discharging compressed air into the gap between the tubular blankets 3 and the blanket barrels 1 from the plurality of non-shown compressed air discharging openings made in the circumferential sections close to the end portions of the blanket barrels 1, thereby facilitating the attaching and detaching operations of the tubular blankets 3.

However, in the case of such tubular blankets, the length of the tubular blanket 3 in its axial directions becomes longer than the width of the web 2, and hence, as shown in FIG. 10, if the web width assumes A or B, the tubular blankets 3 positioned above and below the web 2 results in providing contact areas 4 or 4' where the web 2 does not exist on their circumferential surfaces. That is, in the contact areas 4, 4' where the web 2 is absent on the circumferential surfaces of the tubular blankets 3, the tubular blankets 3 positioned on the upper and lower sides of the web 2 are brought directly into contact with each other without intervene of the web 2 notwithstanding that the web 2 is made to be interposed between the tubular blankets 3. Further, the contact areas 4, 4' where the web 2 is absent on the circumferential surfaces of the tubular blankets 3 enlarge as the web 2 has a smaller width.

In addition, if inks or paper particles coming from the periphery are attached onto the web 2 absent portions on the circumferential surfaces of the tubular blankets 3, since the web 2 does not exist in the web 2 absent areas 4, 4' on the circumferential surfaces of the tubular blankets 3, the inks or paper particles attached thereonto can not shift onto the web 2, with the result that difficulty is encountered to move them in a state of sticking onto the web 2.

For this reason, the inks or paper particles attached in the web 2 absent areas 4, 4' on the circumferential surfaces of the tubular blankets 3 are left to be accumulated therein, and dry and develop heat due to the pressing force working between the tubular blankets 3 positioned above and below the web 2, which can damage the tubular blankets 3.

Moreover, if the web 2 meanders, the web 2 may adhere to the ink accumulated in the web 2 absent areas 4, 4' on the circumferential surfaces of the tubular blankets 3, with the result that there is a possibility that the web 2 is wound around the blanket barrels 1 to be cut off.

Furthermore, in case where the cut-off coming from the winding of the web 2 occurs while the printing machine is in a high-speed operation, until the operation stops after the detection of the web cut-off, the web 2 is wrapped around the blanket barrels 1 in large quantities, and the web 2 is additionally accumulated in the gap between the upper and lower tubular blankets 3 in large quantities, which can make it difficult to put the printing machine into operation because of interfering with the use of the tubular blankets 3.

Besides, the tubular blankets 3 have an excellent high-speed printing performance but are expensive, and are troublesome in replacement, and therefore, in the case of interfering with the use of the tubular blankets 3 as mentioned above, a large loss takes place in economy or in working efficiency.

SUMMARY OF THE INVENTION

The present invention has been developed with a view to eliminating the foregoing problems, and it is therefore an object of this invention to provide a tubular blanket and a printing machine using the tubular blanket which are capable of eliminating the influence from the attachment of inks or paper particles in the web absent area on the circumferential surface of a tubular blanket and of making the web cut-off hard to occur to prevent the interference with the use of the tubular blanket, thereby enhancing the economy and the working efficiency.

For this purpose, a tubular blanket according to this invention is a tubular blanket for a blanket barrel of a printing machine, and is made up of a main blanket section having at least a portion coming into contact with a print-made web, and a remaining blanket section other than the main blanket section, with the remaining blanket section having a thickness thinner than a thickness of the main blanket section.

Preferably, in this tubular blanket, the thickness of the main blanket section is made uniformly.

Furthermore, in the tubular blanket, the boundary portion between the main blanket section and the remaining blanket section can be constructed as a substantially vertical wall portion. In addition, the boundary portion between the main blanket section and the remaining blanket section can be constructed to gradually increase in thickness from the remaining blanket section to the main blanket section.

Still further, it is also appropriate that, in the tubular blanket, the width of the main blanket section is made to be slightly larger than that of the web.

Moreover, a tubular blanket based printing machine according to this invention is composed of a first blanket barrel equipped with a first tubular blanket to make a printing on one surface of a web, a second blanket barrel equipped with a second tubular blanket to make a printing on the other surface of the web, with the first and second blanket barrels being disposed in an opposed relation to each other, wherein at least one of the first and second tubular blankets comprises a main blanket section having at least a portion coming into contact with the web, and a remaining blanket section other than the main blanket section which has a thickness thinner than the thickness of the main blanket section.

In this tubular blanket based printing machine, it is also possible that each of the first and second tubular blankets includes the main blanket section having at least the portion coming into contact with the web, and the remaining blanket section other than the main blanket section which has a thickness thinner than the thickness of the main blanket section.

Furthermore, preferably, in the tubular blanket based printing machine, the thickness of the main blanket section is made uniformly.

Besides, in the tubular blanket based printing machine, the boundary portion between the main blanket section and the remaining blanket section can be constructed as a substantially vertical wall portion. In addition, the boundary portion between the main blanket section and the remaining blanket section can be constructed to gradually increase in thickness from the remaining blanket section to the main blanket section.

Moreover, a tubular blanket based printing machine according to this invention is provided with a blanket barrel having a tubular blanket thereon to make a printing on one surface of a web, wherein the tubular blanket comprises a main blanket section having at least a portion coming into contact with the web, and a remaining blanket section other than the main blanket section formed such that its thickness is thinner than the thickness of the main blanket section.

Likewise, in this tubular blanket based printing machine, it is preferable that the thickness of the main blanket section is made uniformly.

Similarly, in this tubular blanket based printing machine, the boundary portion between the main blanket section and the remaining blanket section can be constructed as a substantially vertical wall portion, or the boundary portion between the main blanket section and the remaining blanket section can be constructed to gradually increase in thickness from the remaining blanket section to the main blanket section.

Accordingly, in tubular blankets according to this invention and a printing machine using the tubular blankets, provided are a main blanket section having a portion coming into contact with a print-made web and a remaining blanket section other than the main blanket section. In this case, the main blanket section is made to have a uniform thickness and the thickness of the remaining blanket section is made to be thinner than that of main blanket section. Thus, the web absent contact area is reducible to a slight quantity, and since in the remaining blanket section there is a gap between the tubular blankets disposed in an opposed relation to each other, even if inks or paper particles coming from the periphery are attached onto the web absent area, the attached inks or paper particles do not cause the damage to the tubular blankets and the replacement of the expensive tubular blankets is reducible, thus improving the economy and the working efficiency.

In addition, even if the web meanders, since the web absent area is small, the web hardly sticks to the ink accumulated in the web absent area to reduce the web cut-off occurring due to the winding of the web around the blanket barrel, and also from this point of view, the replacement of the expensive tubular blankets is reducible, thereby improving the economy and the working efficiency.

Incidentally, if the width of the main blanket section is made to be slightly larger than the width of the web, it is possible to reduce the web absent contact area up to a slight quantity, with the result that inks or paper particles hardly adhere to the web absent contact area, thereby further enhancing the aforesaid effects or advantages.

DESCRIPTION OF THE PREFERRED EMBODIMENTS (A) Description of First Embodiment of the Invention A first embodiment of the present invention will be described hereinbelow with reference to the drawings. A tubular blanket according to the embodiment of this invention is, as well as the prior tubular blanket, for use in a printing unit of a blanket-to-blanket printing machine for conducting a printing on a web.

Figure 5:
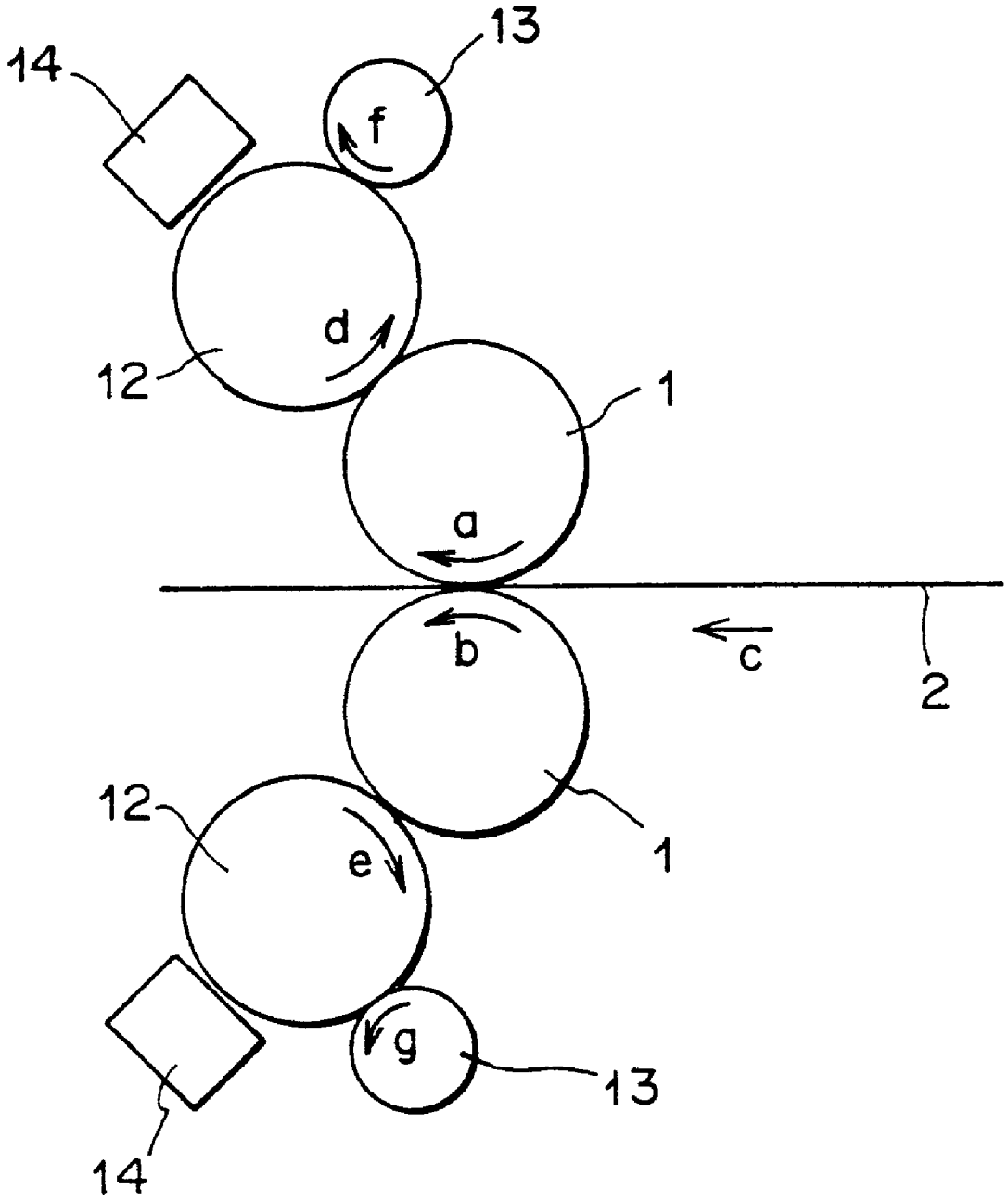
FIG. 5 is a side-elevational cross-sectional view illustratively showing a construction of a blanket-to-blanket printing machine.

First of all, a description will be made hereinbelow of a constitution of a blanket-to-blanket printing machine. As shown in FIG. 5, the blanket-to-blanket printing machine comprises blanket barrels 1, 1, printing cylinders 12, 12, water-giving rollers 13, 13 and ink applying units 14, 14 which are respectively symmetrically disposed in opposed relation with respect to a web 2.

At positions being in an opposed relation to each other to make the web 2 put therebetween, the blanket barrels 1, 1 paired are disposed in parallel to each other to press the web 2 therebetween, while tubular blankets (not shown in FIG. 5) are fitted over the circumferential surfaces of the blanket barrels 1, 1, respectively, so that the web 2 is pressed in a state of being held between the tubular blankets. Further, the blanket barrels 1, 1 are designed to be synchronously rotatable by a drive unit (not shown) in directions of arrows a, b.

In addition, outside the circumferential surfaces of the blanket barrels 1, 1, the printing cylinders 12, 12 are respectively located to be synchronously rotatable in directions of arrows d, e while coming into contact with the tubular blankets fitted over the blanket barrels 1, 1.

Moreover, on the circumferential surfaces of the printing cylinders 12, 12, the water-giving rollers 13, 13 are disposed to be synchronously rotatable in directions of arrows f, g while coming into contact therewith, thereby applying water onto the circumferential surfaces of the printing cylinders 12, 12. Besides, on or in the vicinity of the circumferential surfaces of the printing cylinders 12, 12, the ink applying units 14, 14 are additionally situated in order to apply inks corresponding to a picture pattern to be printed onto the circumferential surfaces of the printing cylinders 12, 12.

With this constitution, in a manner that the water-giving rollers 13, 13 synchronously rotate while coming into contact with the printing cylinders 12, 12, respectively, water adheres onto the circumferential surfaces of the printing cylinders 12, 12, and further, the ink applying units 14, 14 apply inks corresponding to a picture pattern to be printed onto the circumferential surfaces of the printing cylinders 12, 12, respectively.

In this case, when the web 2 is inserted into the gap between the upper and lower blanket barrels 1, 1 to advance in the direction of the arrow c, the blanket barrels 1, 1 each having the tubular blanket thereon and the printing cylinders 12, 12 are first synchronously rotationally driven in contacting conditions, so that the inks applied onto the circumferential surfaces of the printing cylinders 12, 12 are transferred onto the circumferential surfaces of the tubular blankets on the blanket barrels 1, 1, respectively.

In addition, the pair of blanket barrels 1, 1 disposed in an opposed relation to each other in a state where the web 2 is interposed therebetween rotate in the directions of the arrows a, b in accordance with the movement of the web 2 while pressing the web 2 therebetween, whereupon the inks transferred onto the tubular blankets are again transferred onto the web 2, thereby accomplishing the offset printing for the web 2.

Figure 1:
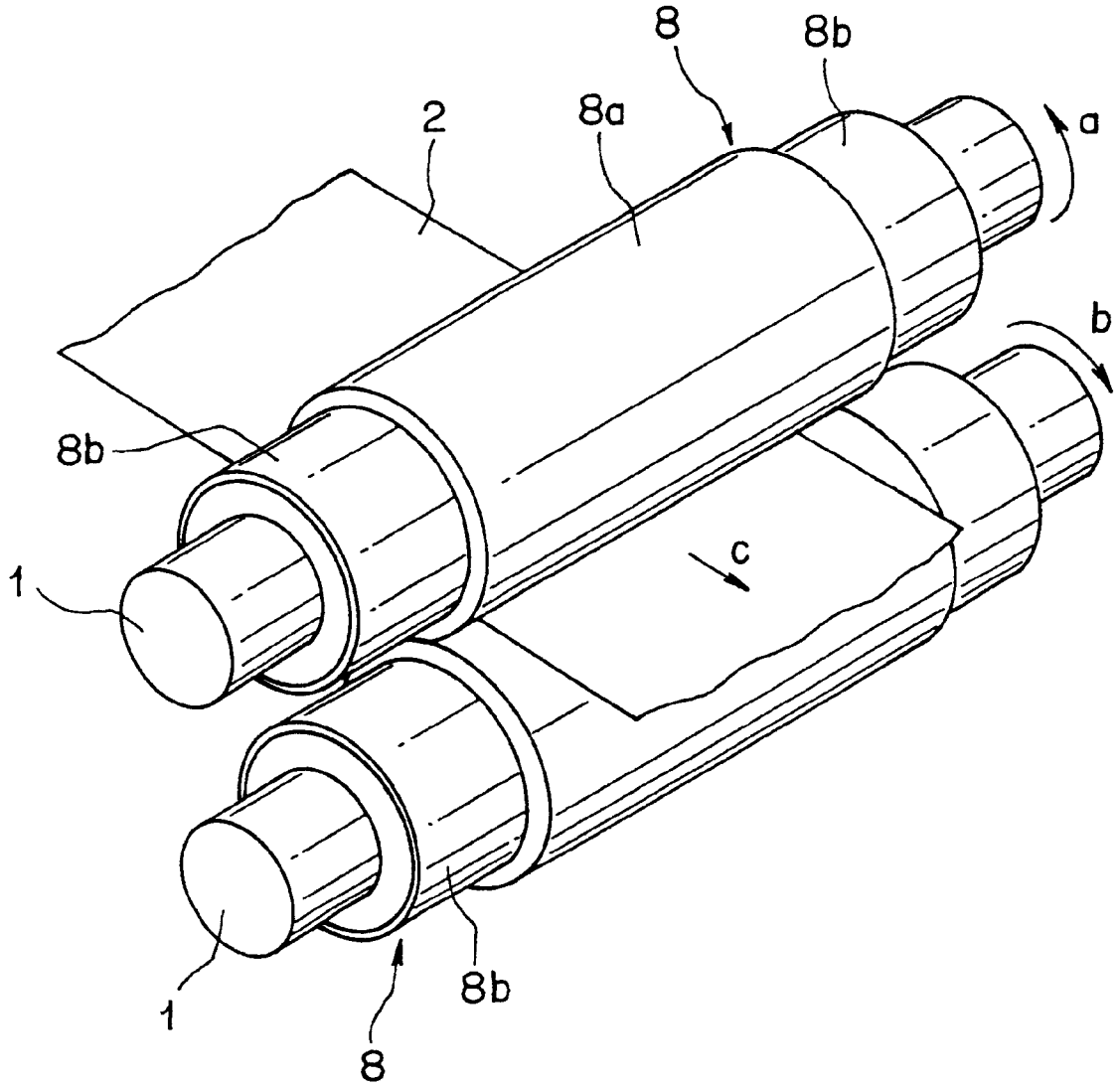
FIG. 1 is a perspective view illustratively showing a construction of a principal section of a blanket-to-blanket printing machine using tubular blankets according to a first embodiment of the present invention.
Figure 2:
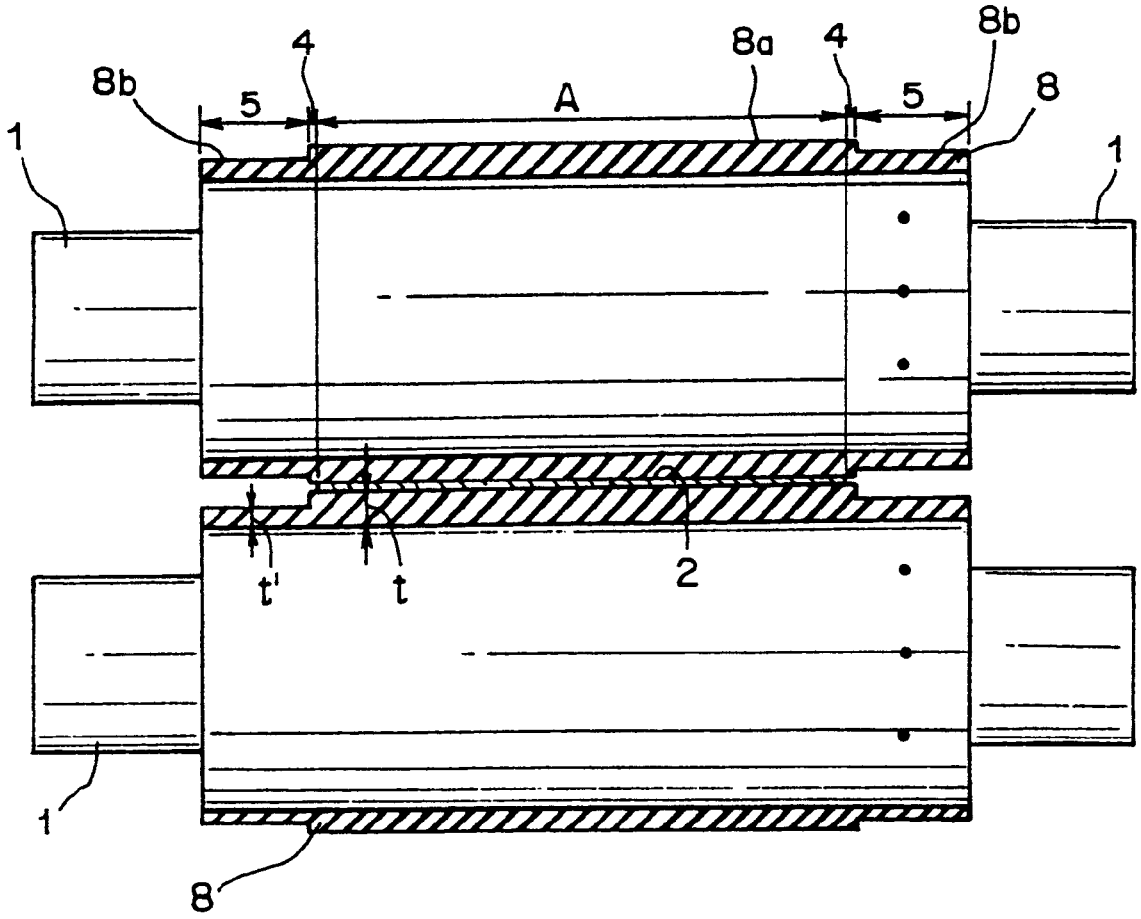
FIG. 2 is a cross-sectional view corresponding to FIG. 1.

As shown in FIGS. 1 and 2, in a printing machine using tubular blankets according to the first embodiment of this invention, a pair of blanket barrels 1 are placed in an opposed relation to each other to interpose a web 2 therebetween, and a plurality of compressed air discharging openings 10 are made in portions of circumferential surfaces of the blanket barrels 1 in the vicinity of their end portions to be arranged in circumferential directions, and tubular blankets 8 are fitted over the overall circumferences of the blanket barrels 1 to cover the compressed air discharging openings 10.

Furthermore, the blanket barrels 1 are positioned so that their tubular blankets 8 press the web 2 therebetween, and the blanket barrels 1 located on the upper and lower sides of the web 2 are made to be synchronously rotatable by a non-shown drive unit in directions of arrows a, b, respectively, as mentioned before. These structures are substantially the same as those of the prior art.

As shown in FIGS. 1 and 2, each of the tubular blankets 8 is composed of a main blanket section 8*a* having a portion coming into contact with the web 2 and remaining blanket sections 8*b* other than the main blanket section 8*a*. Further, the main blanket section 8*a* is formed to have a uniform blanket thickness t, while the remaining blanket sections 8*b* are formed to have a blanket thickness t'(<t) thinner than the thickness of the main blanket section 8*a*.

Still further, the tubular blanket 8 serves as an elastic layer constructed by piling up a blanket layer 7 made of a rubber, a fiber, a resin, an adhesive or the like on a sleeve 6 made of an elastic material such as a metal having a high stiffness. The width of the sleeve 6 of the tubular blanket 8 in its axial directions is set to deal with the width of a printing plate (not shown) corresponding to the maximum sheet width, and in general the width thereof is made to substantially coincide with a width which allows covering the compressed air discharging openings 10 made in the circumferential surface of the blanket barrel 1.

More specifically, for the configuration of the tubular blanket 8, on determining the width of the sheet (web 2) to be used, the main blanket section 8*a* is set to assume an area slightly larger than the range coming contact with the web 2, that is, set to occupy a range spreading to positions on both sides in the axial directions of the blanket barrel 1 to slightly (for example, 5 to 10 mm) exceed the sheet width, and is formed to assume a uniform thickness t, whereas the remaining blanket sections 8*b* other than the main blanket section 8*a* (that is, the sections existing from both the side positions, defining the range slightly exceeding the sheet width, to both the end portions) are formed to have a thickness t' thinner than the blanket thickness t.

Moreover, in the case of largely varying the web width, the tubular blankets 8 are also replaced with ones corresponding to that width. For instance, if the webs to be used have two different widths, two kinds of tubular blankets 8 are prepared.

A description will be made hereinbelow of the case that the web 2 takes web widths A and B different from each other. In the configuration of the tubular blankets 8 to be taken for when making a printing on the web 2 having the web width A, as shown in FIG. 2, the main blanket section 8*a* is set at a substantially central position in its axial directions to occupy an area obtained by respectively adding slight ranges 4 to both sides of a range with a width equal to the width of the web A, and the main blanket section 8*a* is formed to have a uniform thickness t, whereas the remaining blanket sections 8*b* other than the main blanket section 8*a* are formed to have a thickness t' smaller than the blanket thickness t. Whereupon, when the upper and lower tubular blankets 8 press the web 2 therebetween, gap areas 5 are defined between the remaining blanket sections 8*b* of the upper and lower tubular blankets 8.

Figure 3:
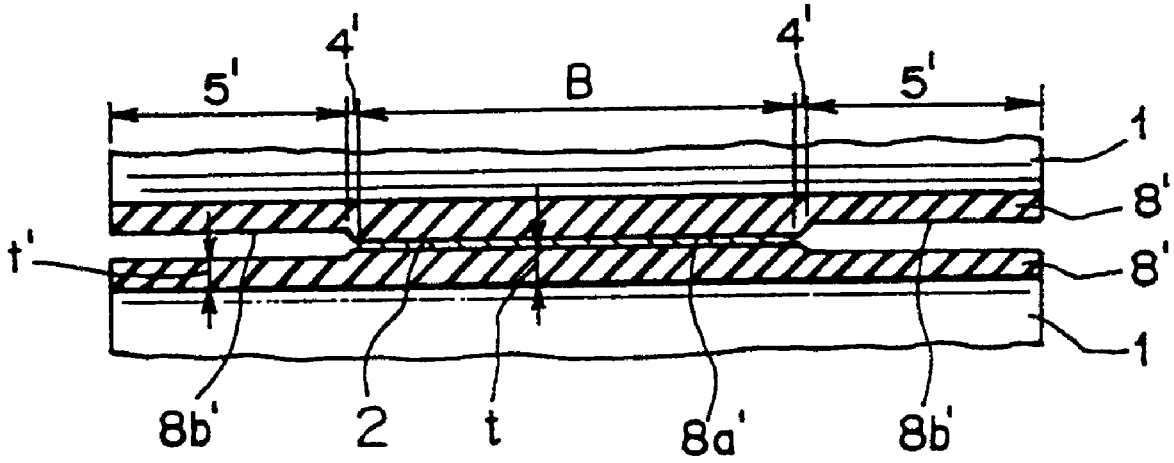
FIG. 3 is a partially cross-sectional view showing the tubular blankets according to the first embodiment of this invention.

In a similar way, in the configuration of the tubular blankets 8' to be taken for when making a printing on the web 2 having the web width B smaller than the web width A, as shown in FIG. 3, the main blanket section 8*a*' is set at a substantially central position in its axial directions to occupy an area obtained by respectively adding slight ranges 4' to both sides of a range with a width equal to the width of the web B, and the main blanket section 8*a*' is formed to have a uniform thickness t, whereas the remaining blanket sections 8*b*' other than the main blanket section 8*a*' are formed to have a thickness t' smaller than the blanket thickness t. Whereupon, when the upper and lower tubular blankets 8' press the web 2 therebetween, gap areas 5' are defined between the remaining blanket sections 8*b*' of the upper and lower tubular blankets 8'.

In consequence, between the upper and lower tubular blankets 8, 8' for pressing the web 2, the remaining blanket sections 8*b,* 8*b*' define web absent gap areas 5, 5', and the web absent contact areas only result in slightly existing between the upper and lower tubular blankets 8, 8' for pressing the web 2.

In the following description, the tubular blankets signify not only the tubular blankets designated at numeral 8 but also the tubular blankets denoted at numeral 8', and the tubular blankets 8 mentioned represent all the tubular blankets. Likewise, the main blanket sections signify not only the main blankets designated at numeral 8*a* but also the main blankets depicted at numeral 8*a*', and the main blanket sections 8*a* mentioned represent all the main blanket sections. Further, the remaining blanket sections also include the remaining blanket sections denoted at numerals 8*b*', and the remaining blanket sections 8*b* mentioned represent all the remaining blanket sections 8*b*.

Figure 4A:
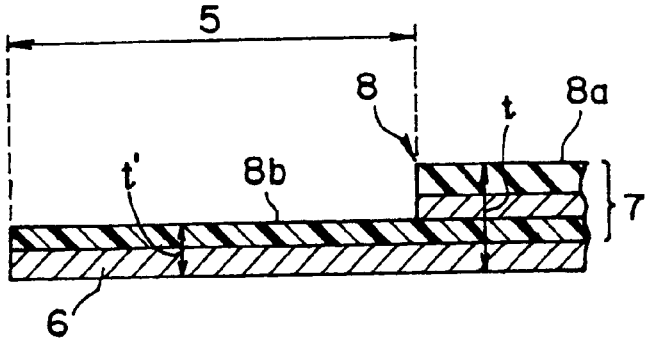
FIGS. 4A to 4C are partially cross-sectional views showing the tubular blankets according to the first embodiment of this invention.
Figure 4B:
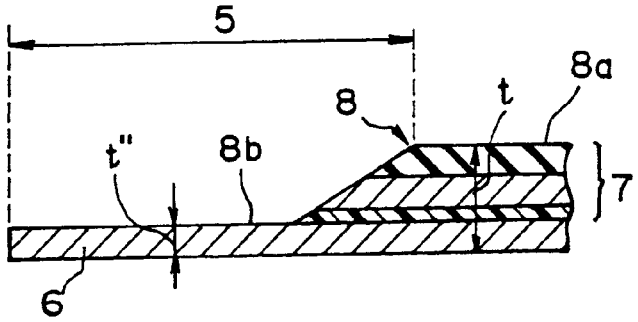
Figure 4C:
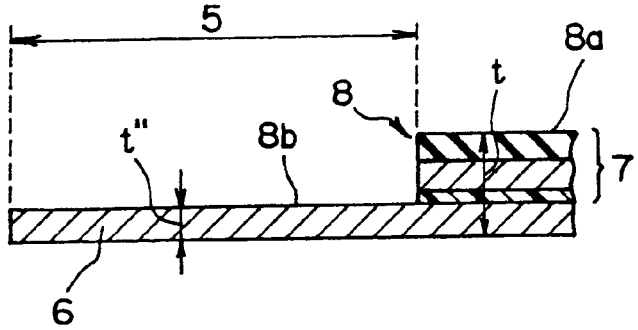

FIGS. 4A to 4C are partially cross-sectional views showing structures of the tubular blankets 8 for reducing the thickness of the tubular blankets 8 to create the web 2 absent gap areas 5.

In the case of the tubular blanket 8 shown in FIG. 4A, a lower layer of the blanket layer 7 extends to end portions of the sleeve 6 in its axial directions, while a portion of an upper layer of the blanket layer 7 is cut off, thereby making the blanket thickness t' smaller than the blanket thickness t.

Furthermore, in the case of the tubular blanket 8 shown in FIG. 4B, the sections having a blanket thickness t" thinner than the blanket thickness t depend upon only the sleeve 6, and the axial end surfaces of the blanket layer 7 piled up on the sleeve 6 are formed to have an inclined (tapered) portion expanding toward the lower layer side (the side placed into contact with the sleeve 6).

Still further, in the tubular blanket 8 shown in FIG. 4C, the sections having a blanket thickness t" thinner than the blanket thickness t rely on only the sleeve 6, and the axial end surfaces of the blanket layer 7 piled up on the sleeve 6 are formed to take a vertical condition.

Incidentally, as mentioned before, the printing cylinders 12 synchronously rotatable with the tubular blankets 8 are located to come into contact with the tubular blankets 8, respectively, as shown in FIG. 5. In a manner that the printing cylinders 12 synchronously rotate while coming into contact with the tubular blankets 8 after inks for a picture pattern and water ate applied onto the circumferential surfaces of the printing cylinders 12, the inks are transferred onto the circumferential surfaces of the tubular blankets 8. Further, when the tubular blankets 8 where the inks transferred on their circumferential surfaces rotate while coming into contact with the web 2, the printing on the web is achievable.

With this construction, if the web 2 is inserted into the gap between the main blanket sections 8*a* of the upper and lower tubular blankets 8 to advance in the direction of the arrow c, the printing cylinders 12 disposed to come into contact with the upper and lower tubular blankets 8 synchronously rotate in the contacting conditions with the tubular blankets 8, so that the inks for a picture pattern, applied onto the circumferential surfaces of the printing cylinders 12 are transferred onto the circumferential surfaces of the main blanket sections 8*a* of the tubular blankets 8.

Furthermore, with the tubular blankets 8 rotating in accordance with the movement of the web 2 while pressing the web therebetween, in the gap between the main blanket sections 8*a* of the tubular blankets 8 located on the upper and lower sides of the web 2, the inks transferred onto the circumferential surfaces of the main blanket sections 8*a* of the tubular blankets 8 are again transferred onto the web 2, thereby accomplishing the offset printing on the web 2.

At detaching the tubular blanket 8 fitted over the blanket barrel 1 or attaching it, compressed air is spouted out from the compressed air discharging openings 10, made in the circumferential sections of the blanket barrel 1 in the vicinity of the axial end portions, into the gap between the tubular blanket 8 and the blanket barrel 1, so that the inner diameter of the tubular blanket 8 enlarges to make the attaching and detaching operations of the tubular blanket 8 facilitated.

As described above, in the tubular blankets according to the first embodiment of this invention and in the printing machine using the same tubular blankets, since the width of the web 2 is substantially equal to the width of the main blanket section 8*a,* the web 2 absent areas 4, 4' only exist by small amounts on the circumferential surfaces of the main blanket sections 8*a,* with the result that the inks or paper particles coming from the periphery hardly adhere to the web 2 absent contact areas 4, 4'.

Furthermore, even if the inks or paper particles coming from the periphery stick to the web 2 absent gap areas 5, 5' (that is, the remaining blanket sections 8*b*), because the gaps are defined between the upper and lower remaining blanket sections 8*b* so that the inks or paper particles coming from the periphery are free from being pressed between the remaining blanket sections 8*b,* the inks or paper particles do not dry or generate heat, with the result that the damage of the tubular blankets 8 is avoidable.

Still further, even if the meander of the web 2 occurs, since the web 2 absent contact areas 4, 4' only exist slightly on the circumferential surfaces of the tubular blankets 8, the web 2 does not adhere to the ink accumulated in the web 2 absent areas 4, 4', thereby preventing the cut-off of the web 2 due to the winding around the blanket barrels 1.

Moreover, even if the inks or paper particles coming from the periphery are accumulated in the web absent gap areas 5, 5' (that is, the remaining blanket sections 8*b*), since the gaps exist between the upper and lower remaining blanket sections 8*b,* the web 2 does not stick to the accumulated ink. Accordingly, also from this point of view, it is possible to prevent the web cut-off originating from the winding of the web 2 around the blanket barrels 1. In addition, because of preventing the web cut-off originating from the web winding, it is possible to eliminate the interference with the use of the tubular blankets 8.

(B) Description of Modification of First Embodiment of the Invention

Figure 6:
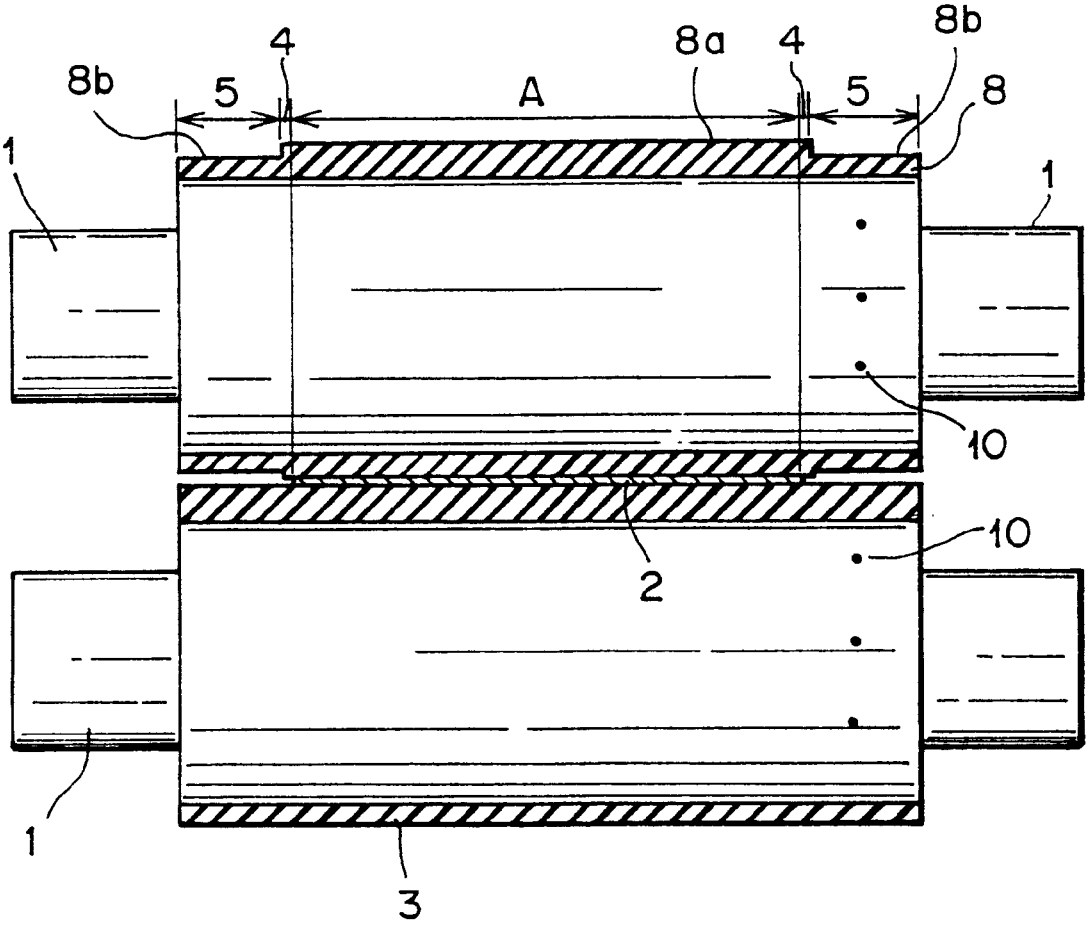
FIG. 6 is an illustrative view showing a construction of a principal section of a modification of the printing machine using the tubular blankets according to the first embodiment of this invention.

Although in the above-described embodiment the tubular blanket 8 is employed in connection with both the blanket barrels of the blanket-to-blanket printing machine, this invention is not limited to this structure, and it is also appropriate that, as shown in FIG. 6, the tubular blanket 8 is used for only one blanket barrel 1 of the blanket-to-blanket printing machine.

Figure 10:
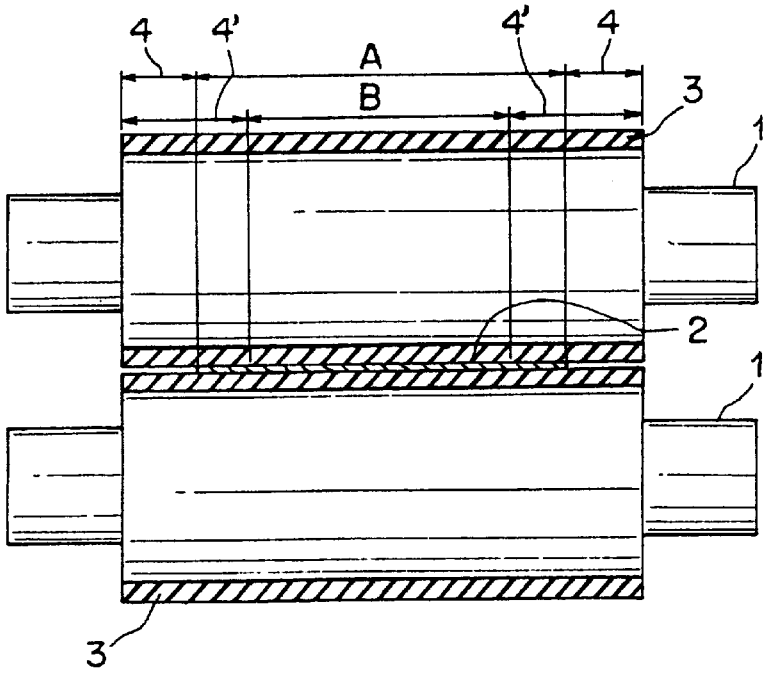
FIG. 10 RELATED ART
FIG. 10 is a cross-sectional view corresponding to FIG. 9.

That is, the blanket-to-blanket printing machine shown in FIG. 6 is also a printing machine using a tubular blanket, and the tubular blanket 8 is fitted over only one of the pair of blanket barrels 1 disposed in an opposed relation to each other in a state where the web 2 is put therebetween in a way similar in the above-described embodiment shown in FIG. 2, whereas a tubular blanket 3 similar to that of the prior art shown in FIG. 10 is fitted over the other blanket barrel 1.

With this construction, if the web 2 is inserted into the gap between the blanket barrels 1 being in the opposed relation to pass therethrough, the offset printing on the web 2 is achievable. Similarly, the tubular blanket and the printing machine based upon the tubular blanket according to the modification of the first embodiment of this invention can prevent the accumulation, drying and heat generation of the inks or paper particles coming from the periphery, thus preventing the damage of the tubular blanket 8 and the adhesion of the web 2 to the ink accumulated in the web 2 absent areas so that the web cut-off originating from the winding of the web 2 around the blanket barrels 1 is avoidable.

Furthermore, even if the inks coming from the periphery are accumulated in the web absent gap areas 5, 5' (i.e., the remaining blanket sections 8*b*), since the one remaining blanket section 8*b* defines a gap with respect to the other, the web 2 does not adhere to the accumulated ink. Also from this point of view, it is possible to prevent the web cut-off originating from the winding of the web 2 around the blanket barrels 1. In addition, because of preventing the web cut-off originating from the web winding, it is possible to eliminate the interference with the use of the tubular blankets 8.

(C) Description of Second Embodiment of the Invention

Figure 7:
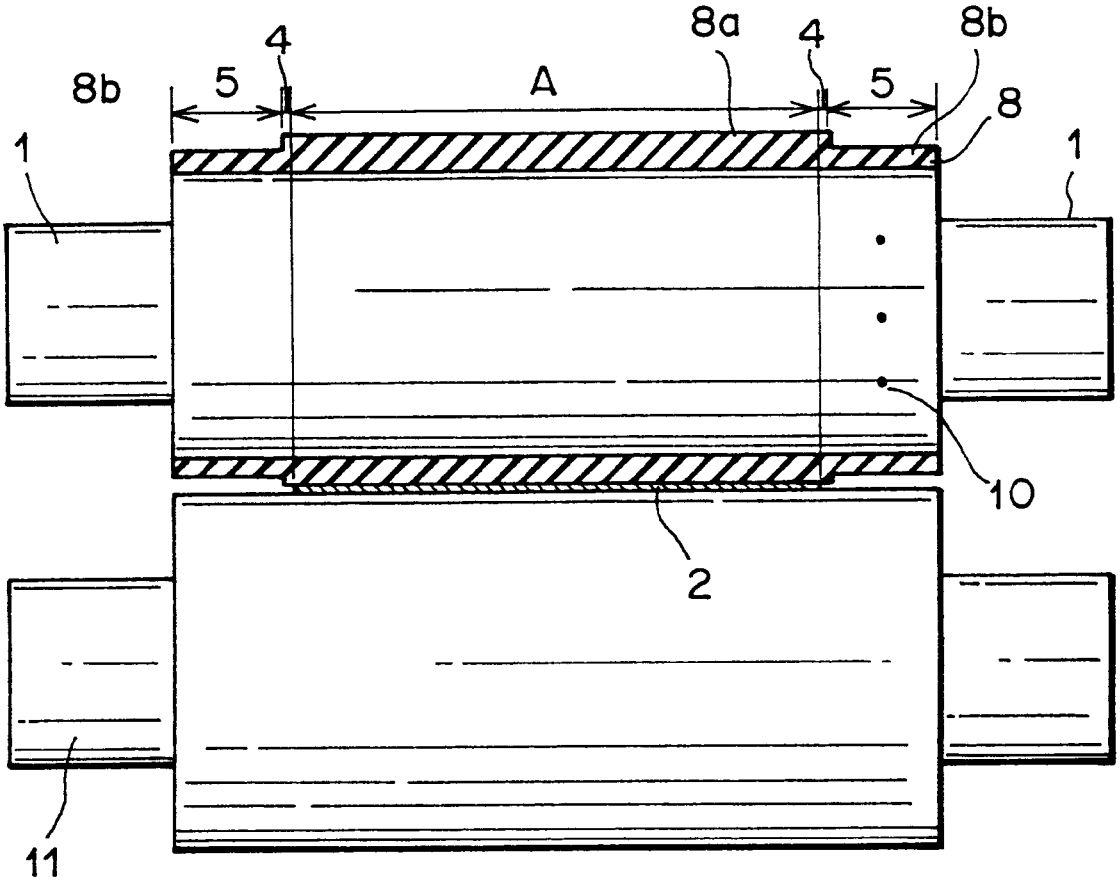
FIG. 7 is a perspective view illustratively showing a construction of a principal section of a printing machine using tubular blankets according to a second embodiment of the present invention.
Figure 8:
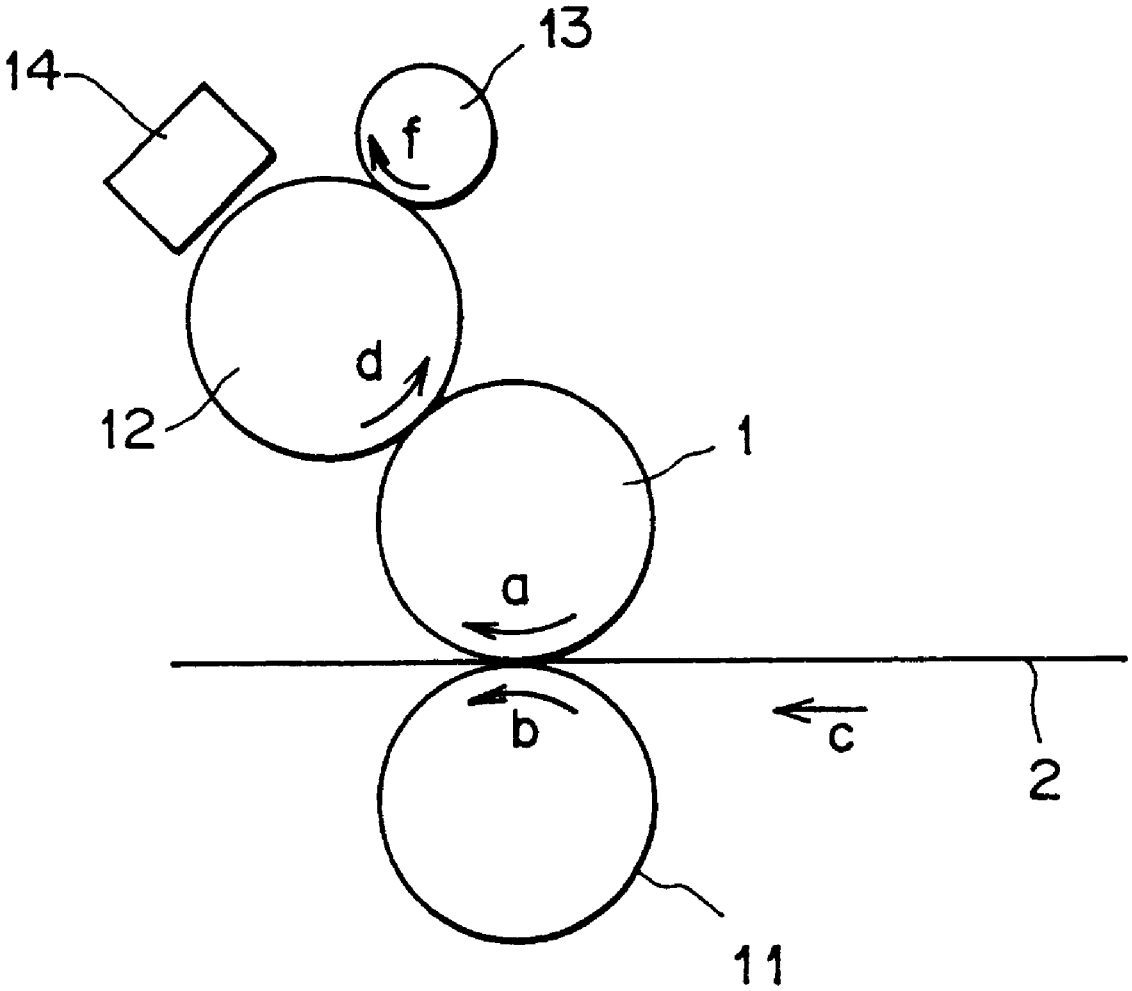
FIG. 8 is a side-elevational cross-sectional view illustratively showing a construction of a principal section of the printing machine using the tubular blankets according to the second embodiment of this invention.
Figure 9:
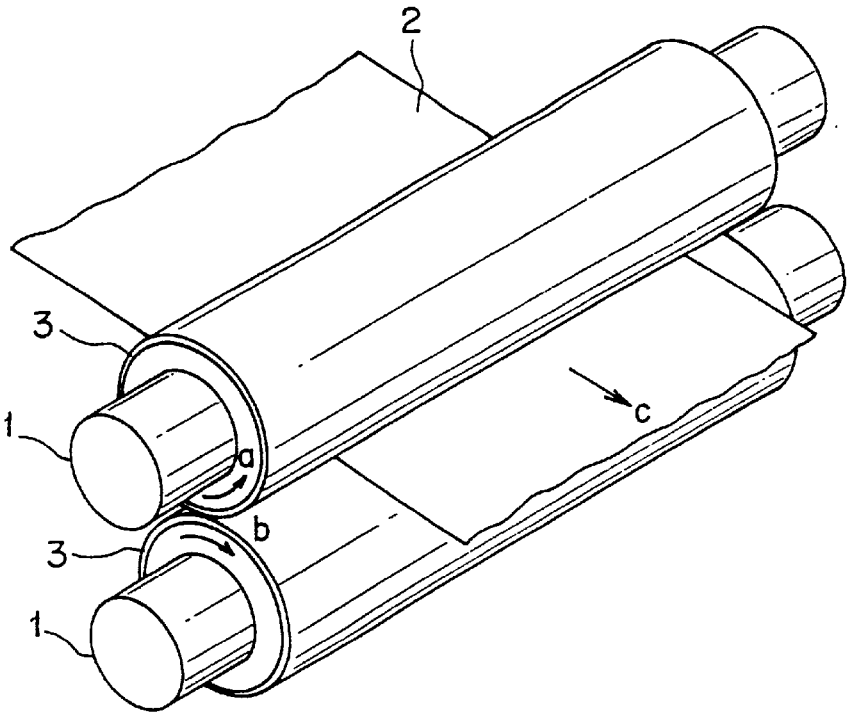
FIG. 9 RELATED ART
FIG. 9 is a perspective view illustratively showing a construction of a principal section of a conventional blanket-to-blanket printing machine using tubular blankets.

Although the description of the above-described embodiment has been made of only the case that the tubular blankets 8 are employed for the blanket-to-blanket printing machine, this invention is not limited to this, and it is also appropriate that they are applied to a printing machine of a type of pressing blankets against a web on an impression cylinder as shown in FIGS. 7 and 8.

More specifically, the printing machine shown in FIGS. 7 and 8 is a printing machine using tubular blankets, and is composed of an impression cylinder 11, a blanket barrel 1, a printing cylinder 12, a water-giving roller 13 and an ink applying unit 14 for accomplishing a single-sided printing on the web 2 on the impression cylinder 11.

The blanket barrel 1 is placed at a position being in an opposed relation to the impression cylinder 11 with respect to the web 2 to be in parallel to the impression cylinder 11, and the blanket barrel 1 carries, thereon, a tubular blanket 8 having the same structure as that in the aforesaid embodiment shown in FIG. 2.

In addition, the blanket barrel 1 and the impression cylinder 11 are made to be synchronously rotatable in directions of arrows a, b through the use of a non-shown drive unit.

Furthermore, the printing cylinder 12 is disposed to come into contact with the circumferential surface of the tubular blanket 8, and the printing cylinder 12 is disposed to be rotatable synchronously with the blanket barrel 1 in a direction of an arrow d.

Still further, the water-giving roller 13 is located to come into contact with the circumferential surface of the printing cylinder 12, and when the water-giving, roller 13 synchronously rotates in a direction of an arrow f, water is given onto the circumferential surface of the printing cylinder 12. Further, the ink applying unit 14 is placed on the circumferential surface of the printing cylinder 12 to apply inks corresponding to a picture pattern to be printed onto the circumferential surface of the printing cylinder 12.

With this constitution, in a manner that the water-giving roller 13 synchronously rotates while coming into contact with the printing cylinder 12, water adheres to the circumferential surface of the printing cylinder 12, and further, the inks corresponding to a picture pattern to be printed are attached onto the circumferential surface of the printing cylinder 12 by means of the ink applying unit 14.

When the web 2 is inserted into the gap between the blanket barrel 1 and the impression cylinder 11 to proceed in a direction of an arrow c, the printing cylinder 12 and the tubular blanket 8 first rotate synchronously while coming into contact with each other, so that the inks applied onto the circumferential surface of the printing cylinder 12 are transferred onto the circumferential surface of the tubular blanket 8 on the blanket barrel 1.

Moreover, when the blanket barrel 1 and the impression cylinder 11 disposed in an opposed relation to each other to interpose the web 2 therebetween rotate in the directions of the arrows a, b in accordance with the movement of the web 2 while pressing the web 2 therebetween, the inks transferred onto the tubular blanket 8 are again transferred onto the web 2, thereby accomplishing the offset printing on the web 2.

Thus, even if the tubular blanket according to this invention is applied to a printing machine of a type of pressing a blanket against a web on an impression cylinder, it is possible to obtain the same effects as those attainable when applying it to the above-described blanket-to-blanket printing machine.

(D) Others

Although in the above-described embodiments the tubular blankets 8 are replaced in the case of largely changing the width of the web 2, this invention is not limited to this, and in the case that the width of the web 2 takes various values, if sacrificing that the web 2 absent blanket contact area becomes slightly larger, it may be possible to reduce the kinds of tubular blankets 8 to be prepared.

In addition, although in the above-described embodiments various cross-sectional configurations for the tubular blankets 8 are taken as shown in FIGS. 4A to 4C, this invention is not limited to these tubular blanket 8 cross-sectional configurations, and a limitation is not imposed on a relationship with the blanket layer 7, the shapes thereof, and others. It should be understood that various modifications are possible as long as they do not constitute departures from the spirit and scope of the invention.

Moreover, although in the above-described embodiments the tubular blanket 8 is designed such that the main blanket section 8*a* is formed at its axial central section and the remaining blanket sections 8*b* are formed on both the sides of the main blanket section 8*a,* this invention is not limited to this, and the main blanket section 8*a* can be at any position on the tubular blanket 8 in its axial directions.

What is claimed is:

1. A tubular blanket for use in a printing machine which operates to make printing on any one web selected from a plurality of webs of different widths and has (i) a blanket barrel having a width larger than the width of the widest web, (ii) a plurality of tubular blankets to be selected one at a time, which corresponds to the selected web, for being mounted on the blanket barrel, each of the plural tubular blankets having a width substantially equal to the width of the blanket barrel, and (iii) an impression cylinder having a width larger than the width of the widest web and disposed radially opposite to the blanket barrel for holding the selected web between confronting circumferential surfaces of the selected tubular blanket and the impression cylinder while printing takes place on one side of the selected web, said blanket being one of the plural tubular blankets and corresponding to a predetermined one of the plural webs and comprising:

a central blanket section having a width substantially equal to the width of the predetermined web and having a circumferential surface engageable with the predetermined web during printing; and a pair of marginal blanket sections disposed one at each of the opposite ends of said central blanket section;

each of said marginal blanket sections having a diameter less than the diameter of said central blanket section so that, when said tubular blanket is mounted on the blanket barrel so as to radially confront the impression cylinder, an ink escape gap is defined between a circumferential surface of each of said marginal blanket sections and the circumferential surface of the impression cylinder.

2. A tubular blanket as defined in claim 1, wherein the diameter of said central blanket section is uniform throughout its entire width.

3. A tubular blanket as defined in claim 1, wherein said central blanket section and each said marginal blanket section are divided by an annular wall whose plane is substantially radial of said tubular blanket.

4. A tubular blanket as defined in claim 1, wherein said central blanket section and each said marginal blanket section are divided by an annular wall whose plane tapers axially outwardly of said tubular blanket.

5. A tubular blanket as defined in claim 1, wherein said central blanket section has a pair of extra parts at each of opposite ends of said central blanket section so as to cover a possible maximum width of a meandering passage of the predetermined web during printing.

6. A printing machine for printing on both sides of any one web selected from a plurality of webs of different widths, comprising:

a first blanket barrel having a width larger than the width of the widest web;

a plurality of first tubular blankets to be selected one at a time, which corresponds to the selected web, for being mounted on said first blanket barrel, each of said first tubular blankets having a width substantially equal to the width of said first blanket barrel;

a second blanket barrel having a width larger than the width of the widest web and disposed radially opposite to said first blanket barrel; and a plurality of second tubular blanket to be selected one at a time, which corresponds to the selected web, for being mounted on said second blanket barrel for holding the web between confronting circumferential surfaces of said selected first tubular blanket and said selected second tubular blanket while printing takes place on both sides of the selected web, each os said second tubular blankets having a width substantially equal to the width of said second blanket barrel;

one of each said first tubular blanket and each said second tubular blanket including a central blanket section having a predetermined width substantially equal to the width of the corresponding web and having the circumferential surface engageable with the selected web during printing, and a pair of marginal blanket sections disposed one at each of opposite ends of said central blanket section, each of said marginal blanket sections having a diameter less than the diameter of said central blanket section so that, when both said selected first tubular blanket and said selected second tubular blanket are mounted on said first and second blanket barrels respectively so as to radially confront each other, an ink escape gap is defined between a circumferential surface of each of said marginal blanket sections of the one selected tubular blanket and the circumferential surface of the mating selected tubular blanket.

7. A printing machine as defined in claim 6, wherein the other of each said first tubular blanket and each said second tubular blanket also includes:

a central blanket section having a width substantially equal to the width of the corresponding web and having a circumferential surface engageable with the selected web during printing; and a pair of marginal blanket sections disposed one at each of opposite ends of said central blanket section;

each of said marginal blanket sections having a diameter less than the diameter of said central blanket section so that, when both said selected first tubular blanket and said selected second tubular blanket are mounted on said first and second blanket barrels respectively so as to radially confront each other, an ink escape gap is defined between a circumferential surface of each of said marginal blanket sections of the one selected tubular blanket and a circumferential surface of each of said marginal blanket sections of the mating selected tubular blanket.

8. A printing machine as defined in claim 6, wherein the diameter of said central blanket section is uniform throughout its entire width.

9. A printing machine as defined in claim 6, wherein said central blanket section and each said marginal blanket section are divided by an annular wall whose plane is substantially radial of each said tubular blanket.

10. A printing machine as defined in claim 6, wherein said central blanket section and each said marginal blanket section are divided by an annular wall whose plane tapers axially outwardly of said tubular blanket.

11. A printing machine for printing on one side of any one web selected from a plurality of webs of different widths, comprising:

a blanket barrel having a width larger than the width of the widest web;

a plurality of tubular blankets to be selected one at a time, which corresponds to the selected web, for being mounted on said blanket barrel, each said tubular blanket having a width substantially equal to the width of said blanket barrel; and an impression cylinder having a width larger than the width of the widest web and disposed radially opposite to of said blanket barrel for holding the selected web between confronting circumferential surfaces of said selected tubular blanket and said impression cylinder while printing takes place on one side of the selected web;

each said tubular blanket including a central blanket section having a width substantially equal to the width of the corresponding web and having the circumferential surface engageable with the selected web during printing, and a pair of marginal blanket sections disposed one at each of opposite ends of said central blanket section, each of said marginal blanket sections having a diameter less than the diameter of said central blanket section so that, when said selected tubular blanket is mounted on said blanket barrel so as to radially confront said impression cylinder, an ink escape gap is defined between a circumferential surface of each of said marginal blanket sections of said selected tubular blanket and the circumferential surface of said impression cylinder.

12. A printing machine as defined in claim 11, wherein the diameter of said central blanket section is uniform throughout its entire width.

13. A printing machine as defined in claim 11, wherein said central blanket section and each said marginal blanket section are divided by an annular wall whose plane is substantially radial of each said tubular blanket.

14. A printing machine as defined in claim 11, wherein said central blanket section and each said marginal blanket section are divided by an annular wall whose plane tapers axially outwardly of each said tubular blanket.

15. A tubular blanket for use in a printing machine which operates to make printing on any one web selected from a plurality of webs of different widths and has (i) a blanket barrel having a width larger than the width of the widest web and also having compressed-air discharging openings at opposite ends on a circumferential surface of the blanket barrel, (ii) a plurality of tubular blankets, each having a width substantially equal to the width of the blanket barrel, to be selected one at a time, which corresponds to the selected web, for being mounted on the blanket barrel, and (iii) an impression cylinder having a width larger than the width of the widest web and disposed radially opposite to the blanket barrel for holding the selected web between confronting circumferential surfaces of the selected tubular blanket and the impression cylinder while printing takes place on one side of the selected web, said blanket being adapted to be one of the plural tubular blankets and comprising:

a central blanket section having a width substantially equal to the width of the corresponding web and having a circumferential surface engageable with the selected web during printing, and a pair of marginal blanket sections disposed one at each of opposite ends of said central blanket section so as to cover the compressed-air discharging openings of said blanket barrel when said selected tubular blanket is mounted on said corresponding blanket barrel, each of said marginal blanket sections having a diameter less than the diameter less than the diameter of said central blanket section so that, when said tubular blanket is mounted on the blanket barrel so as to radially confront the impression cylinder, an ink escape gap is defined between a circumferential surface of each of said marginal blanket sections and the circumferential surface of the impression cylinder.

16. A printing machine for printing on both sides of any one web selected from a plurality of webs of different widths, comprising:

a first blanket barrel having a width larger than the width of the widest web and also having compressed-air discharging openings at opposite ends on a circumferential surface of the first blanket barrel;

a plurality of first tubular blankets to be selected one at a time, which corresponds to the selected web, for being mounted on said first blanket barrel, each said first tubular blankets having a width substantially equal to the width of said first blanket barrel;

a second blanket barrel having a width larger than the width of the widest web and disposed radially opposite to said first blanket barrel and also having compressed-air discharging openings at opposite ends on a circumferential surface of the second blanket barrel; and a plurality of second tubular blankets to be selected one at a time, which corresponds to the selected web, for being mounted on said second blanket barrel for holding the web between confronting circumferential surfaces of said selected first tubular blanket and said selected second tubular blanket while printing takes place on both sides of the selected web, each of said second tubular blankets having a width substantially equal to the width of said second blanket barrel;

at least one of each said first tubular blanket and each said second tubular blanket including a central blanket section having a predetermined width substantially equal to the width of the corresponding web and having the circumferential surface engageable with the selected web during printing, and a pair of marginal blanket sections disposed one at each of opposite ends of said central blanket section so as to cover the compressed-air discharging openings of said blanket barrel when said selected tubular blanket is mounted on said corresponding blanket barrel, each of said marginal blanket sections having a diameter less than the diameter of said central blanket section so that, when both said selected first tubular blanket and said elected second tubular blanket are mounted on said first and second blanket barrels respectively so as to radially confront each other, an ink escape gap is defined between a circumferential surface of each of said marginal blanket sections of the one selected tubular blanket and the circumferential surface of the mating selected tubular blanket.

17. A printing machine for printing on one side of any one web selected from a plurality of webs of different widths, comprising:

a blanket barrel having a width larger than the width of the widest web and also having compressed-air discharging openings at opposite ends on a circumferential surface of said blanket barrel;

a plurality of tubular blankets to be selected one at a time, which corresponds to the selected web, for being mounted on said blanket barrel, each said tubular blanket having a width substantially equal to the width of said blanket barrel; and an impression cylinder having a width larger than the width of the widest web and disposed radially opposite to said blanket barrel for holding the selected web between confronting circumferential surfaces of said selected tubular blanket and said impression cylinder while printing takes place on one side of the selected web;

each said tubular blanket including a central blanket section having a width substantially equal to the width of the corresponding web and having the circumferential surface engageable with the selected web during printing, and a pair of marginal blanket sections disposed one at each of opposite ends of said central blanket section so as to cover the compressed-air discharging openings of said blanket barrel when said selected tubular blanket is mounted on said blanket barrel, each of said marginal blanket sections having a diameter less than the diameter of said central blanket section so that, when said selected tubular blanket is mounted on said blanket barrel so as to radially confront said impression cylinder, an ink escape gap is defined between a circumferential surface of each of said marginal blanket sections of said selected tubular blanket and the circumferential surface of said impression cylinder.

18. A printing machine for printing on both sides of any one web selected from a plurality of webs of different widths, comprising;

a first blanket barrel having a width larger than the width of the widest web and also having compressed-air discharging openings at opposite ends on a circumferential surface of said first blanket barrel;

a first tubular blanket being one of a plurality of tubular blankets which correspond to the plural webs and are selected one at a time for being mounted on said first blanket barrel, said first tubular blanket corresponding to a predetermined one of the plural webs and having a width substantially equal to the width of said first blanket barrel;

a second blanket barrel having a width larger than the width of the predetermined web and disposed radially opposite to said first blanket barrel and also having compressed-air discharging openings at opposite ends on a circumferential surface of said second blanket barrel; and a second tubular blanket being one of a plurality of tubular blankets which correspond to the plural webs and are selected one at a time for being mounted on said second blanket barrel, said second tubular blanket corresponding to the predetermined web and having a width substantially equal to the width of said second blanket barrel;

wherein when both said first tubular blanket and said second tubular blankets are mounted on said first and second blanket barrels respectively, said printer is operable to hold the predetermined web between confronting circumferential surfaces of said first tubular blanket and said second tubular blanket while printing takes place on both sides of the predetermined web, and wherein at least one of said first tubular blanket and said second tubular blanket includes:

a central blanket section having a predetermined width substantially equal to the width of the predetermined web and having the circumferential surface engageable with the predetermined web during printing, and a pair of marginal blanket sections disposed one at each of opposite ends of said central blanket section, each of said marginal blanket sections having a diameter less than the diameter of said central blanket section so that, when both said first tubular blanket and said second tubular blanket are mounted on said first and second blanket barrels respectively so as to radially confront each other, an ink escape gap is defined between a circumferential surface of each said marginal blanket sections of the one tubular blanket and the circumferential surface of the mating tubular blanket.

19. A printing machine for printing on one side of any one web selected from a plurality of webs of different widths, comprising:

a blanket barrel having a width larger than the width of the widest web and also having compressed-air discharging openings at opposite ends on a circumferential surface of said blanket barrel;

a tubular blanket being one of a plurality of tubular blankets which correspond to the plural webs and are selected one at a time for being mounted on said blanket barrel, said tubular blanket corresponding to a predetermined one of the plural webs and having a width substantially equal to the width of said blanket barrel; and an impression cylinder having a width larger than the width of the widest web and disposed radially opposite to said blanket barrel for holding the predetermined web between confronting circumferential surfaces of said tubular blanket and said impression cylinder while printing takes place on one side of the predetermined web;

said tubular blanket including:

a central blanket section having a width substantially equal to the width of the predetermined web and having the circumferential surface engageable with the predetermined web during printing, and a pair of marginal blanket sections disposed one at each of opposite ends of said central blanket section, each of said marginal blanket sections having a diameter less than the diameter of said central blanket section so that, when said tubular blanket is mounted on said blanket barrel so as to radially confront said impression cylinder, an ink escape is defined between a circumferential surface of each of said marginal blanket sections of said tubular blanket and the circumferential surface of said impression cylinder.

20. A printing blanket assembly for use in a printing machine which operates to make printing on any web selected from a plurality of webs of different widths and includes an impression cylinder having a width larger than the width of the widest web, said assembly comprising:

a blanket barrel having a width larger than the width of the widest web and disposed radially opposite to the impression cylinder; and a plurality of tubular blankets to be selected one at a time, which corresponds to the selected web, for being mounted on said blanket barrel for holding the selected web between confronting circumferential surfaces of said selected tubular blanket and the impression cylinder while printing takes place on one side of the selected web, each of said plural tubular blankets having a width substantially equal to the width of said blanket barrel;

each said tubular blanket including:

a central blanket section having a width substantially equal to the width of the corresponding web and having the circumferential surface engageable with the selected web during printing, and a pair of marginal blanket sections disposed one at each of opposite ends of said central blanket section, each of said marginal blanket sections having a diameter less than the diameter of said central blanket section so that, when said selected tubular blanket is mounted on said blanket barrel so as to radially confront the impression cylinder, an ink escape gap is defined between a circumferential surface of each of said marginal blanket sections of said selected tubular blanket and the circumferential surface of the impression cylinder.

* * * * *